US011131219B2

(12) United States Patent
Miura et al.

(10) Patent No.: US 11,131,219 B2
(45) Date of Patent: Sep. 28, 2021

(54) ROCKER ARM

(71) Applicant: MITSUBISHI HEAVY INDUSTRIES ENGINE & TURBOCHARGER, LTD., Sagamihara (JP)

(72) Inventors: Shuichi Miura, Tokyo (JP); Seiji Tsuruoka, Tokyo (JP); Takahiro Sushi, Tokyo (JP); Kenjiro Oda, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 121 days.

(21) Appl. No.: 16/097,326

(22) PCT Filed: Oct. 20, 2017

(86) PCT No.: PCT/JP2017/038037
§ 371 (c)(1),
(2) Date: Oct. 29, 2018

(87) PCT Pub. No.: WO2018/074596
PCT Pub. Date: Apr. 26, 2018

(65) Prior Publication Data

US 2019/0093523 A1 Mar. 28, 2019

(30) Foreign Application Priority Data

Oct. 20, 2016 (JP) ..... JP2016-206287

(51) Int. Cl.
*F01L 1/18* (2006.01)

(52) U.S. Cl.
CPC ..... *F01L 1/181* (2013.01); *F01L 1/18* (2013.01); *F01L 1/182* (2013.01); *F01L 2301/00* (2020.05)

(58) Field of Classification Search
CPC ... F01L 1/181; F01L 1/18; F01L 1/182; F01L 1/185; F01L 13/0021; F01L 2103/00;
(Continued)

(56) References Cited

U.S. PATENT DOCUMENTS 636,070 A * 10/1899 Schenck ..... F01L 1/181 74/519
4,473,047 A * 9/1984 Jakuba ..... F01L 13/065 123/323

(Continued)

FOREIGN PATENT DOCUMENTS

EP 3 150 809 A1 4/2017
JP 59-137309 U 9/1984

(Continued)

OTHER PUBLICATIONS

Written Opinion of the International Searching Authority and International Search Report (forms PCT/ISA/237, PCT/ISA/210 and PCT/ISA/220), dated Dec. 12, 2017, for International Application No. PCT/JP2017/038037, with an English translation of the Written Opinion.

(Continued)

*Primary Examiner* — Daniel D Yabut
(74) *Attorney, Agent, or Firm* — Birch, Stewart, Kolasch & Birch, LLP

(57) ABSTRACT

A rocker arm swingably supported by an arm shaft and operating a valve by rotation of a cam includes an arm body part including a bearing portion supported by the arm shaft, a cam-side arm portion extending from the bearing portion toward a first side, and a valve-side arm portion extending from the bearing portion toward a second side, an arch part extending over the bearing portion and connecting the cam-side arm portion and the valve-side arm portion, and a lightweight part disposed in a space defined between the arm body part and the arch part and having a reduced weight (Continued)

compared with a case where the space is filled with the same material at the same thickness as the arch part.

8 Claims, 7 Drawing Sheets

(58) Field of Classification Search
CPC ..... B21K 1/205; Y10T 74/20882; Y10T 74/2107; Y10T 74/20582; Y10T 29/49295
See application file for complete search history.

(56) References Cited

U.S. PATENT DOCUMENTS

| | | | | | |
|---|---|---|---|---|---|
| 5,185,923 | A * | 2/1993 | Taniguchi | F01L 1/143 | 123/90.51 |
| 5,335,636 | A * | 8/1994 | Bilei | F01L 13/06 | 123/321 |
| 5,993,978 | A * | 11/1999 | Kim | F01L 1/14 | 428/553 |
| 6,237,551 | B1 * | 5/2001 | Macor | F01L 1/08 | 123/90.12 |
| 7,185,618 | B1 * | 3/2007 | Edelmayer | F01L 1/181 | 123/90.39 |
| 9,551,242 | B2 * | 1/2017 | Graham | B23P 6/00 | |
| 2002/0139337 | A1 * | 10/2002 | Rosenbush | F01L 1/18 | 123/90.39 |
| 2006/0124096 | A1 | 6/2006 | Weaver | | |
| 2006/0288973 | A1 * | 12/2006 | Hathaway | F01L 1/181 | 123/90.43 |
| 2008/0135000 | A1 | 6/2008 | Jeffries et al. | | |
| 2008/0229578 | A1 * | 9/2008 | Edelmayer | F01L 1/2411 | 29/888.2 |
| 2008/0271692 | A1 * | 11/2008 | Weaver | F01L 1/182 | 123/90.39 |
| 2013/0055973 | A1 * | 3/2013 | D'epiro | F01L 13/0026 | 123/90.11 |
| 2016/0138436 | A1 * | 5/2016 | Young | B23P 6/00 | 123/90.39 |
| 2016/0177866 | A1 | 6/2016 | Frode et al. | | |
| 2017/0252795 | A1 | 9/2017 | Ikeda et al. | | |

FOREIGN PATENT DOCUMENTS

| | | | |
|---|---|---|---|
| JP | 59-159710 | U | 10/1984 |
| JP | 59-179205 | U | 11/1984 |
| JP | 59-208112 | A | 11/1984 |
| JP | 60-14211 | U | 1/1985 |
| JP | 60-65212 | A | 4/1985 |
| JP | 60-77708 | U | 5/1985 |
| JP | 61-78204 | U | 5/1986 |
| JP | 62-90904 | U | 6/1987 |
| JP | 5-73211 | U | 10/1993 |
| JP | 2001-55911 | A | 2/2001 |
| JP | 2002-322903 | A | 11/2002 |
| JP | 2016-98906 | A | 5/2016 |

OTHER PUBLICATIONS

Extended European Search Report effective Jul. 5, 2019 issued in the corresponding European Application No. 17861358.4.
Office Action dated Jun. 2, 2020 issued in counterpart Japanese Application No. 2016-206287 with a machine translation.
Japanese Office Action, dated Oct. 13, 2020, for Japanese Application No. 2016-206287, with an English machine translation.

* cited by examiner

ROCKER ARM

TECHNICAL FIELD

The present disclosure relates to the shape of a rocker arm of a valve train of an engine.

BACKGROUND ART

To improve the efficiency of an engine, various attempts have been made: for instance, the rotational speed of a crank shaft is increased for improving the power density of the engine (output power per unit weight), and an intake valve is closed earlier for realizing a high expansion ratio cycle. An actual valve opening time during intake and exhaust in a combustion chamber thus tends to decrease. When the operating speed of the valve increases, the inertia of a valve train increases accordingly, which easily causes jumping and bouncing of the valve. The jumping is a phenomenal behavior in which the valve jumps and lifts higher than a set value when the valve is open, due to elastic deformation and vibration of the valve train. The bouncing is a phenomenal behavior in which the valve is seated on a valve seat and then strongly hits and bounces thereon. The jumping causes problems such as breakage of parts including the valve and a piston of the engine, as well as deviation of the open/close timing of the valve due to acceleration of the valve seating speed. On the other hand, a reduction in pumping loss is significant to improve the efficiency of the engine. However, the reduction in pumping loss needs to reduce pressure loss due to the valve at intake and exhaust in the combustion chamber. To avoid jumping of the valve, it is considered to decrease the open and closing height of the valve. However, when the open and closing height of the valve decreases, the pressure loss due to the valve increases. Thus, this method has a dilemma that the increase in pumping loss degrades the efficiency of the engine.

Besides, jumping in a high-rotational region of the engine is caused by, for instance, an increase in inertia due to a large mass of parts including a rocker arm which constitutes the valve train or vibration of the entire valve train due to a small natural frequency of the valve train itself compared with the rotational speed of the engine. In this regard, the stiffness of the rocker arm significantly affects vibration characteristics of the valve train. Conventionally, there is suggested a shape capable of increasing the stiffness of the rocker arm while the weight (moment of inertia) of the rocker arm is kept as small as possible (for instance, Patent Documents 1 and 2).

For instance, Patent Document 1 discloses a rocker arm having a rib formed to stand over a cam-side arm and a valve-side arm, in which an upper end portion of the rib at the valve-side arm is convex in the rib height direction, and an upper end portion of the rib at the cam-side arm is concave in the rib height direction. Such a rocker arm can increase the stiffness without increasing an inertia moment around an arm shaft, compared with a conventional rocker arm having a rib whose upper end portion is linearly formed. A valve train equipped with this rocker arm improves the followability of the valve with respect to a predetermined lift and enables the jumping and the bouncing to be shifted to a higher rotational region. Patent Document 2 discloses a rocker arm having a relatively small thickness in the width direction and having a reverse T-shaped cross-section in which a reinforcing rib is provided on the lower end, whereby it is possible to achieve a reduced weight and a high stiffness.

CITATION LIST

Patent Literature

Patent Document 1: JP2001-55911A
Patent Document 2: JPS62-90904U (Utility Model)

SUMMARY

Problems to be Solved

The shapes of the rocker arms of Patent Documents 1 and 2 are basically determined by designers who regards the rocker arm as a beam so that the stiffness of the rocker arm regarded as the beam is increased. As a result, the rocker arm is basically shaped in such a manner that a shaft portion, for receiving an arm shaft, located in the middle is thick and the thickness of the rocker arm gradually decreases from the shaft portion to the ends. Herein, the present inventors have analyzed the shape of the rocker arm with a modern mathematical method such as topology optimization and found a novel rocker arm shape on the basis of analysis results.

In view of the above, an object of at least one embodiment of the present invention is to provide a rocker arm having a significantly increased stiffness while suppressing the increase in weight.

Solution to the Problems (1) A rocker arm according to at least one embodiment of the present invention is a rocker arm swingably supported by an arm shaft and operating a valve by rotation of a cam, the rocker arm comprising: an arm body part including a bearing portion supported by the arm shaft, a cam-side arm portion extending from the bearing portion toward a first side, and a valve-side arm portion extending from the bearing portion toward a second side; an arch part extending over the bearing portion and connecting the cam-side arm portion and the valve-side arm portion; and a lightweight part disposed in a space defined between the arm body part and the arch part, the lightweight part having a reduced weight compared with a case where the space is filled with the same material at the same thickness as the arch part.

With the above configuration (1), it is possible to significantly increase the stiffness of the rocker arm while suppressing the increase in weight of the rocker arm. That is, the rocker arm, in which the arch part extends over the bearing portion and is connected to the arm body part as well as the lightweight part is disposed between the arch part and the arm body part, has a truss structure. In other words, the truss structure allows a bending load which acts on the rocker arm to be supported by an axial load in the arch part. Thereby, it is possible to improve the stiffness of the rocker arm, compared with a rocker arm having a conventional beam structure. Further, it is possible to suppress the increase in weight of the rocker arm by the lightweight part, compared with a case where the space defined between the arm body part and the arch part is filled with the same material at the same thickness as the arch part, for instance, like a case where the rocker arm does not include the lightweight part, and the arm body part is provided with a rib (a rib composed of a portion corresponding to the arch part and a portion corresponding to the lightweight part). Consequently, it is possible to significantly increase the stiffness of the rocker arm by the arch part while suppressing the increase in weight of the rocker arm by the lightweight part.

Furthermore, with the above configuration, since the stiffness is increased while suppressing the increase in weight of the rocker arm, it is possible to improve the natural frequency of a valve train including the rocker arm, and it is possible to suppress the occurrence of jumping of the valve train. Further, since the occurrence of jumping of the valve train is suppressed, it is possible to increase the open and closing height of the valve such as an intake valve and an exhaust valve. This reduces pressure loss (pumping loss) at intake and exhaust, thus improving the efficiency of the engine. Further, since the seating speed of the valve or the like can be decreased, it is possible to elongate the lifetime of the parts, and it is possible to prevent troubles associated with breakage of the parts. It is possible to decrease a reduction in lift amount caused when, for instance, an early closing of the intake valve is performed for improving the efficiency of the engine.

(2) In some embodiments, in the above configuration (1), the lightweight part is composed of a plate member disposed so as to fill the space and having a smaller thickness than the arch part.

With the above configuration (2), since the arch part is supported by the lightweight part composed of the plate member, the arch part can be reinforced. Thus, it is possible to improve the strength (durability) of the arch part. Further, the lightweight part can be easily produced by forming the lightweight part in a plate shape.

(3) In some embodiments, in the above configuration (1), the lightweight part is composed of a plurality of rod members arranged at an interval in the space and connecting the arm body part and the arch part.

With the above configuration (3), since the arch part is supported by the plurality of rod members which are, for instance, arranged spokewise to form the lightweight part, the arch part can be reinforced. Thus, it is possible to improve the strength (durability) of the arch part. Further, since the lightweight part is formed by the plurality of rod members, it is possible to further reduce the weight of the rocker arm.

(4) In some embodiments, in any one of the above configurations (1) to (3), the arch part has an apex at which a separation distance from a reference line connecting a cam-side load application point and a valve-side load application point is maximized, and the arch part is shaped so that the separation distance increases from the valve-side arm portion toward the apex and the separation distance decreases from the apex toward the cam-side arm portion.

With the above configuration (4), the arch part has the apex at which the distance from the reference line, which is a straight line connecting the cam-side application point and the valve-side load application point, is maximized, and the distance from the reference line increases from each load application point toward the apex. Thereby, it is possible to more efficiently increase the stiffness of the rocker arm by the arch part.

(5) In some embodiments, in the above configuration (4), a valve-side distance between an oscillation center of the rocker arm and the valve-side load application point is larger than a cam-side distance between the oscillation center and the cam-side load application point, and the apex is positioned on a valve-side load application point side with respect to the oscillation center.

With the above configuration (5), since the valve-side distance is longer than the cam-side distance, it is possible to increase the open and closing height of the valve in accordance with a cam lift amount. Further, since the apex of the arch part is positioned on the valve-side load application point side with respect to the oscillation center of the rocker arm, it is possible to more efficiently increase the stiffness of the rocker arm by the arch part.

(6) In some embodiments, in the above configuration (5), a thickness of the arch part is 5% or more and 15% or less of a length obtained by adding the valve-side distance to the cam-side distance.

The present inventors have intensively studied and found that, although the stiffness of the rocker arm increases as the thickness (length in depth of the figure described later) of the arch part increases, the stiffness becomes saturated and no longer increases when a ratio of the thickness of the arch part to the sum of the valve-side distance and the cam-side distance reaches a predetermined value. With the above configuration (6), since the thickness of the arch part is determined based on the above-described novel finding, it is possible to more efficiently increase the stiffness while suppressing the increase in weight of the rocker arm.

(7) In some embodiments, in the above configuration (5) or (6), the separation distance of the apex from the reference line is equal to or less than the valve-side distance.

The stiffness of the rocker arm is increased by the arch part as the separation distance of the apex from the reference line increases. However, when the separation distance exceeds a certain value, the stiffness no longer increases and becomes saturated. On the other hand, as the separation distance increases, the entire length of the arch part increases, and thus the weight of the rocker arm increases. With the above configuration (7), since the separation distance of the apex from the reference line is equal to or less than the valve-side distance, it is possible to more efficiently increase the stiffness while suppressing the increase in weight of the rocker arm.

(8) In some embodiments, in any one of the above configurations (5) to (7), a ratio (q/p) of a distance q between the cam-side load application point and an intersection between the reference line and a perpendicular line passing through the apex and perpendicular to the reference line to a distance p between the valve-side load application point and the intersection ranges from 0.8 to 1.2.

With the above configuration (8), it is possible to more efficiently increase the stiffness by the arch part while suppressing the increase in weight of the rocker arm.

Advantageous Effects

According to at least one embodiment of the present invention, there is provided a rocker arm having a significantly increased stiffness while suppressing the increase in weight.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
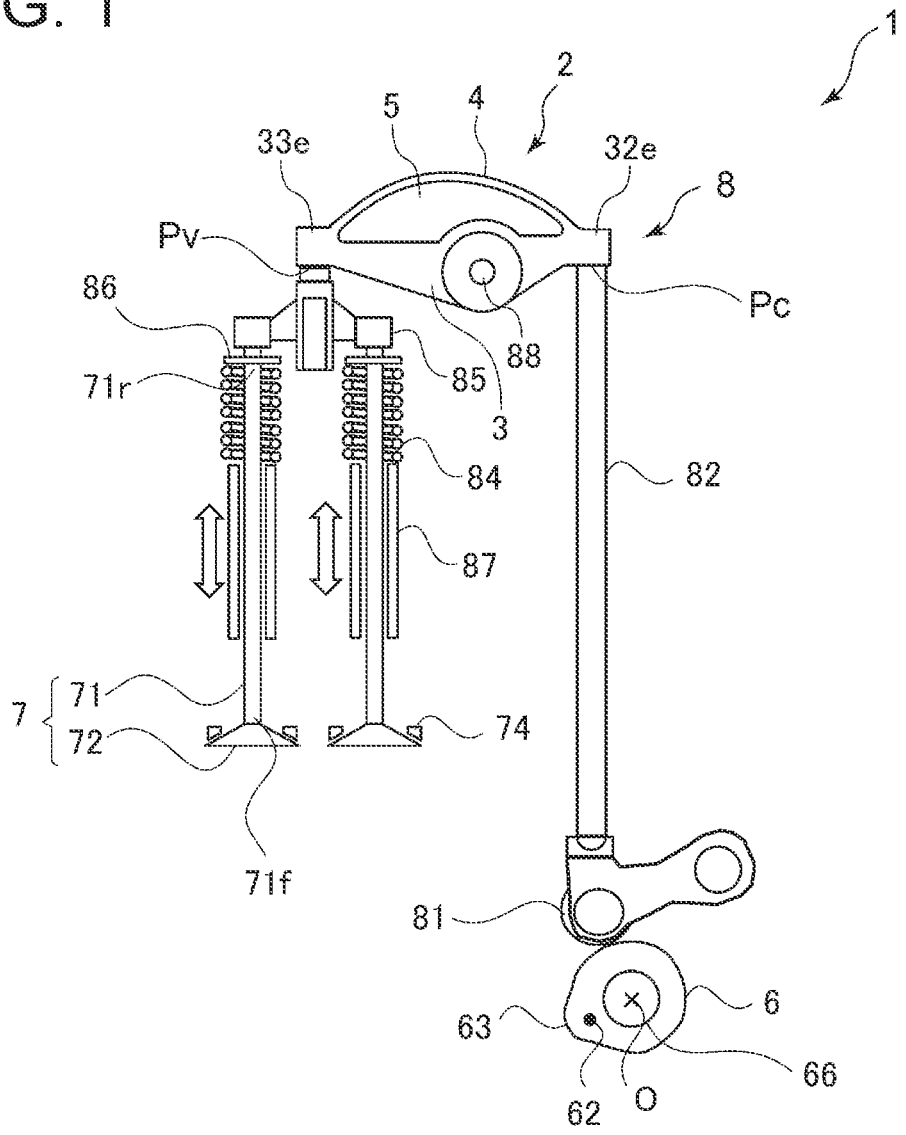
FIG. 1 is a front view of a valve train of an engine including a rocker arm according to an embodiment of the present invention.

FIG. 1 is a front view of a valve train 1 of an engine including a rocker arm 2 according to an embodiment of the present invention. The valve train 1 of the engine (hereinafter, valve train 1) is a mechanical system for opening and closing a valve 7, such as an intake valve and an exhaust valve, included in the engine. As shown in FIG. 1, the valve train 1 includes a cam 6, the valve 7, and a transmission mechanism 8 which drives the valve 7 in accordance with a cam lift amount of the cam 6. First, a configuration of the valve train 1 will be described.

The cam 6 is a component of a mechanism which converts rotational movement to linear movement. That is, the cam 6 rotates with a rotating cam shaft 66 and abuts on a follower (a cam follower 81 in the example of FIG. 1) of the transmission mechanism 8 described later. When the follower is pushed by the rotating cam 6, the follower moves linearly. More specifically, the cam 6 typically has an oval cross-section with a protruding portion (protrusion 62); since the cam 6 has the protrusion 62, a distance between a rotational center O of the cam 6 and an outer periphery of the cam 6 is not wholly constant. Thus, when an outer peripheral position (contact position) in contact with the follower is changed with the rotation of the cam 6, a distance between the contact position and the rotational center O of the cam 6 is changed, and the follower is pushed depending on this distance.

Specifically, the distance between the outer periphery and the rotational center O of the cam 6 increases around the protrusion 62 and is maximized at a top 63 of the protrusion 62. Conversely, the distance between the outer periphery and the rotational center O of the cam 6 decreases as the contact position moves away from the top 63 of the protrusion 62. Thus, the cam lift amount, which is a displacement amount of the follower pushed by the cam 6, significantly depends on the cam shape. Specifically, the cam lift amount increases as the contact position becomes closer to the protrusion 62, and the cam lift amount is maximized at the top 63 of the protrusion 62. Conversely, the cam lift amount decreases from the maximum value as the contact position moves away from the top 63 of the protrusion 62.

The valve 7 is an intake valve or an exhaust valve which controls the open/close state of an intake port and an exhaust port in a cylinder head of the engine. As shown in FIG. 1, the valve 7 includes a rod-shaped shaft portion 71 and a disc-shaped head portion 72 connected to a front end 71*f* of the shaft portion 71. In accordance with a contact state between the head portion 72 and a valve seat 74, the open/close state of the intake port and the exhaust port is controlled. That is, the intake port and the exhaust port of the engine are closed when the head portion 72 is in contact with the valve seat 74; conversely, they are open when the head portion 72 is not in contact with the valve seat 74. The open/close control of the valve 7 is performed by the cam 6 and the transmission mechanism 8 described below.

The transmission mechanism 8 is implemented with a rocker arm system and drives the valve 7 in accordance with the cam lift amount of the cam 6. In other words, the transmission mechanism 8 implemented with the rocker arm system converts the cam lift amount to a valve lift amount, which is a displacement amount of the valve 7 from a seating state on the valve seat 74. More specifically, as shown in FIG. 1, the transmission mechanism 8 is connected to a back end 71*r* of the shaft portion 71 of the valve 7. Further, as described above, the follower of the transmission mechanism 8 converts the rotational movement of the cam 6 to the cam lift amount, and the transmission mechanism 8 moves the valve 7 linearly by the valve lift amount corresponding to the cam lift amount. Specifically, when the back end 71*r* of the shaft portion 71 of the valve 7 is pushed by the transmission mechanism 8 with an increase in valve lift amount, the valve 7 is opened while contracting a spring 84 disposed between an acting plate 86 and a guide portion 87 and inserted into the shaft portion 71 of the valve 7. Conversely, when the force applied to the back end 71*r* of the shaft portion 71 of the valve 7 by the transmission mechanism 8 is weakened with a decrease in valve lift amount, the valve 7 is closed by a force of the contracted spring 84 to return.

Further, in the rocker arm system, a fixation portion (a later-described bearing portion 31), at which the rocker arm 2 is fixed to the cylinder head or the like, serves as a fulcrum PP of a lever, and the cam 6 side is connected on a side of a point of effort (a later-described cam-side load application point Pc) of the rocker arm 2, while the valve 7 side is connected on a side of a point of load (a later-described valve-side load application point Pv) of the rocker arm 2. In the valve train 1 shown in FIG. 1, the transmission mechanism 8 includes the above-described spring 84, the rocker arm 2 (oscillating arm), the cam follower 81 (sliding cylinder) corresponding to the follower, a push rod 82 connecting the cam follower 81 and the point of effort of the rocker arm 2, a bridge 85 connecting the point of load of the rocker arm 2 and the back end 71*r* of the valve 7, and the acting plate 86 disposed between the spring 84 and the rocker arm 2 and fixed to one end (back end 71*r*) of the spring 84. The cam 6 abuts on the cam follower 81 (follower) and thereby is connected to the rocker arm 2 indirectly via the cam follower 81 and the push rod 82. On the other hand, the valve 7 is connected to the rocker arm 2 indirectly via the bridge 85 by connecting the bridge 85 to the back end 71*r* of the valve 7 to which the acting plate 86 is fixed.

With this mechanical system, the transmission mechanism 8 converts the valve lift amount on the cam 6 side to the cam lift amount on the valve 7 side. In other words, the valve train 1 includes the cam shaft 66, the cam 6, the cam follower 81, the push rod 82, the rocker arm 2, the bridge 85, the acting plate 86, and the valve 7, and the valve 7 is driven by the valve lift amount in accordance with the cam lift amount generated by the rotation of the cam 6. In some other embodiments, the transmission mechanism 8 may not include the cam follower 81 and the push rod 82, and the rocker arm 2 may be configured to be lifted directly by the cam 6 by bringing the cam 6 into contact with the rocker arm 2 (directly connecting the cam 6 to the rocker arm 2).

Figure 2:
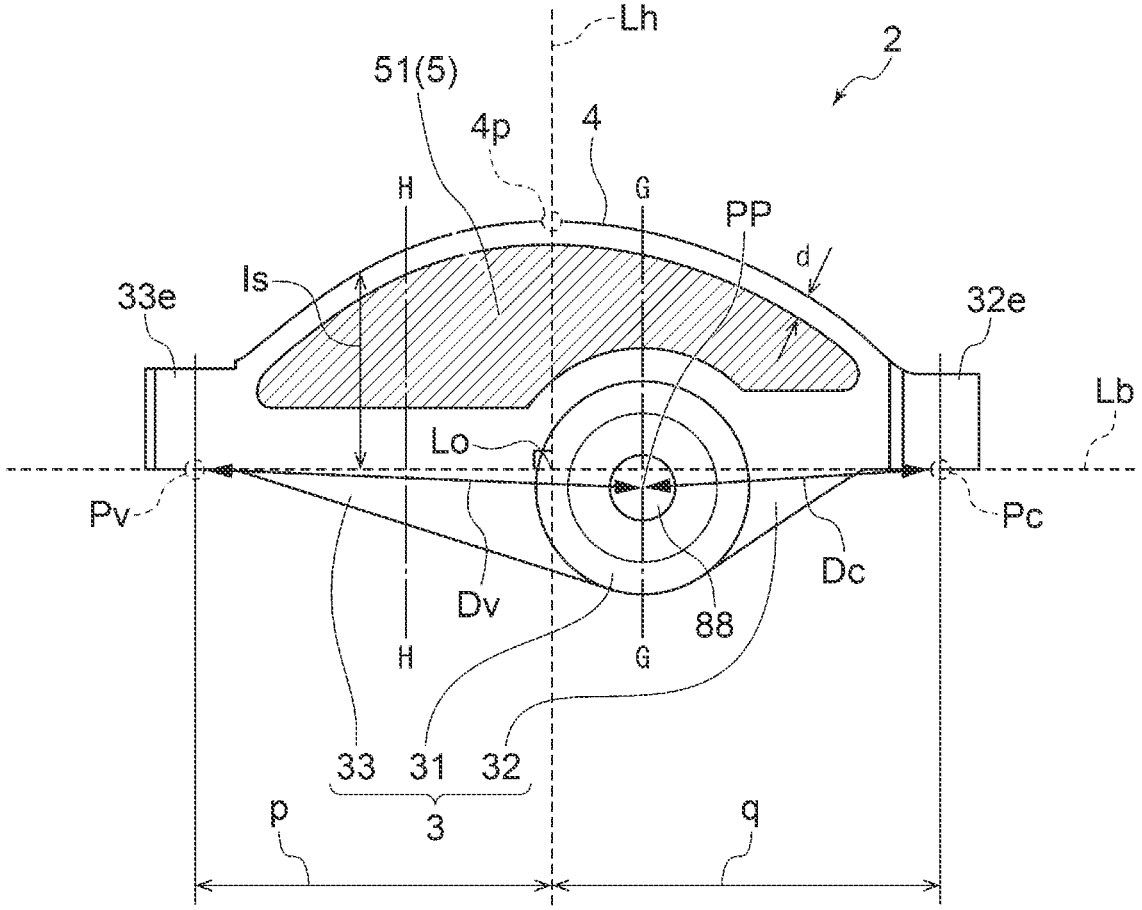
FIG. 2 is a diagram showing a rocker arm according to an embodiment of the present invention, in which a lightweight part is composed of a plate member.
Figure 3A:
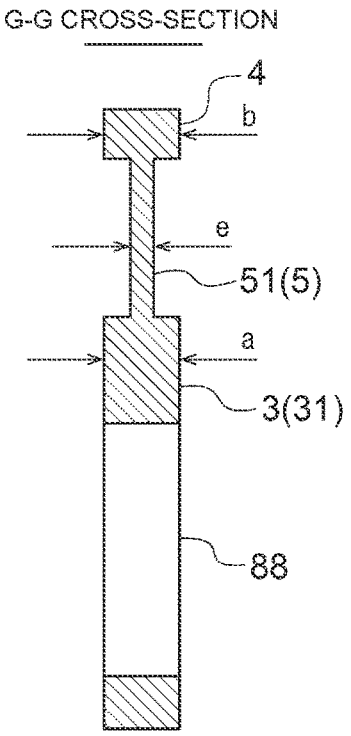
FIG. 3A is a cross-sectional view of a rocker arm according to an embodiment of the present invention, corresponding to GG cross-section of FIG. 2.
Figure 3B:
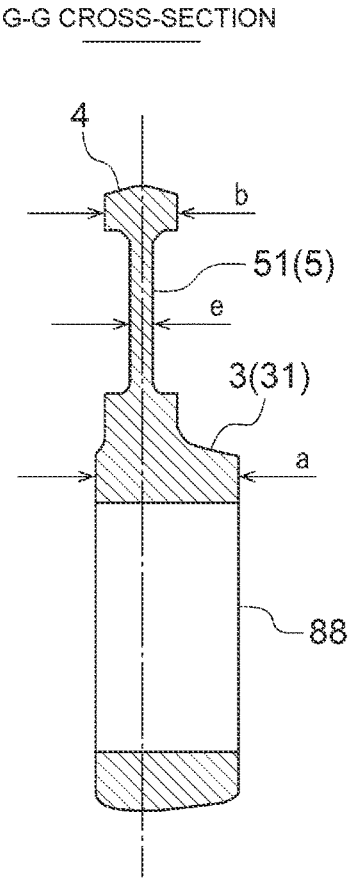
FIG. 3B is a cross-sectional view of a rocker arm according to another embodiment of the present invention, corresponding to GG cross-section of FIG. 2.
Figure 4:
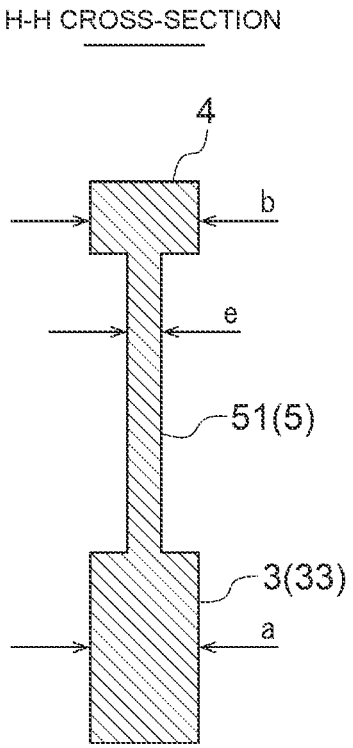
FIG. 4 is a cross-sectional view of a rocker arm according to an embodiment of the present invention, corresponding to HH cross-section of FIG. 2.
Figure 5:
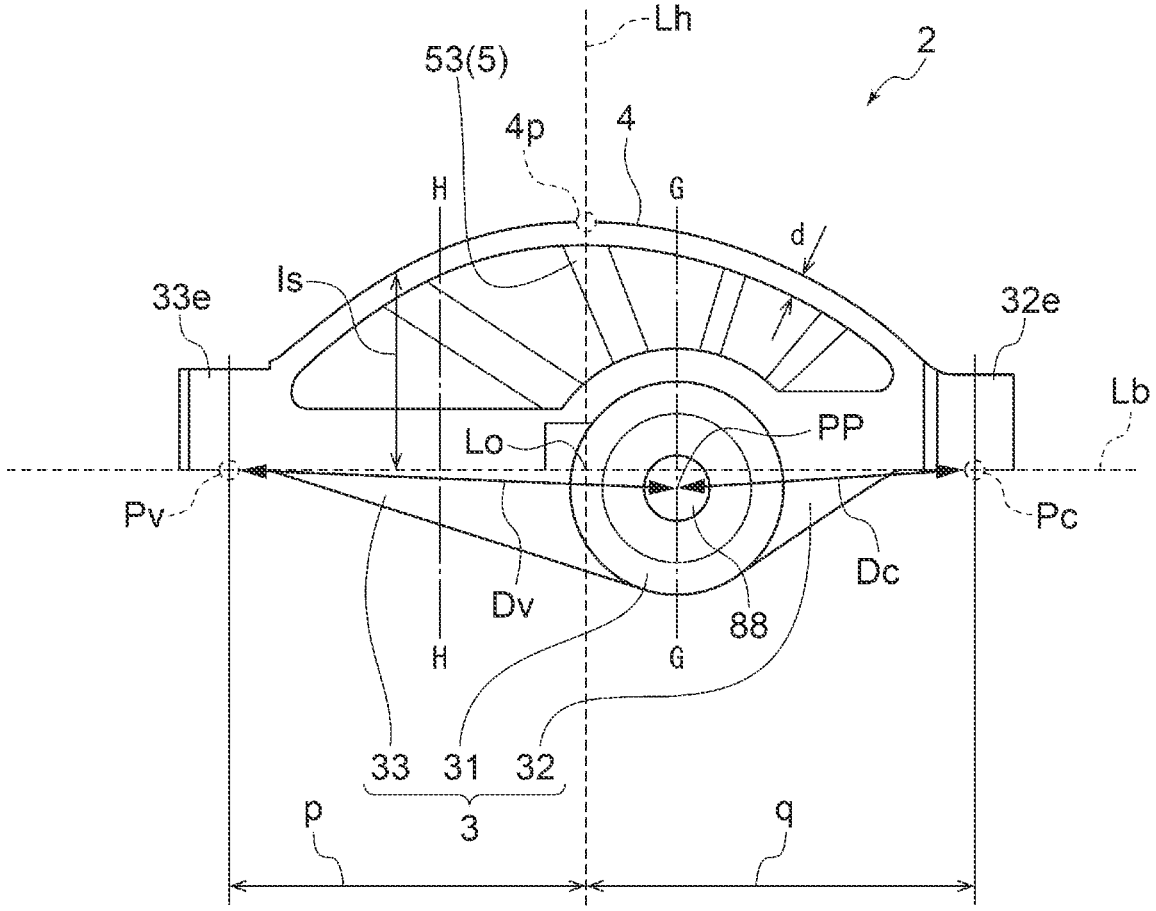
FIG. 5 is a diagram showing a rocker arm according to an embodiment of the present invention, in which a lightweight part is composed of a plurality of rod members.
Figure 6:
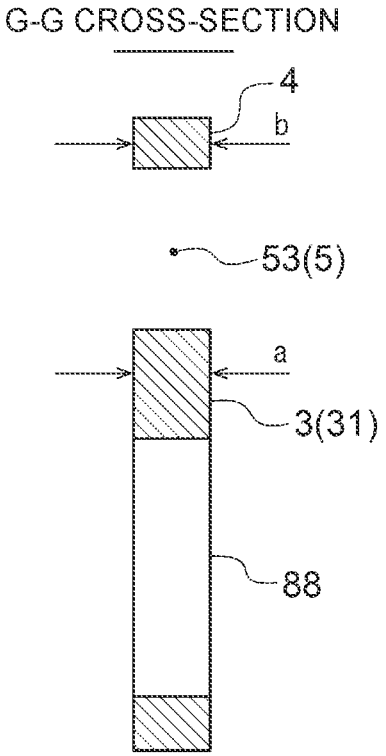
FIG. 6 is a cross-sectional view of a rocker arm according to an embodiment of the present invention, corresponding to GG cross-section of FIG. 5.
Figure 7:
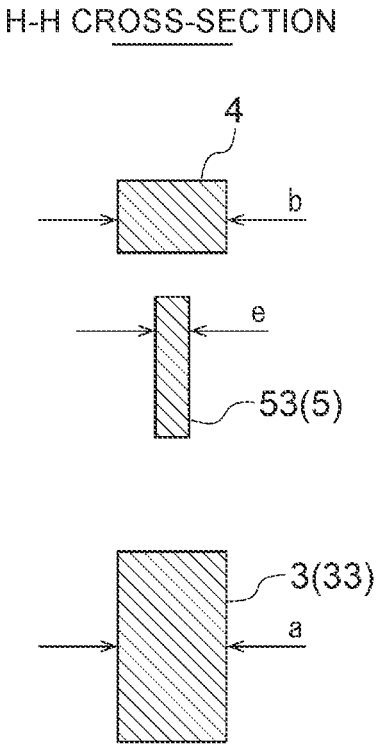
FIG. 7 is a cross-sectional view of a rocker arm according to an embodiment of the present invention, corresponding to HH cross-section of FIG. 5.
Figure 8:
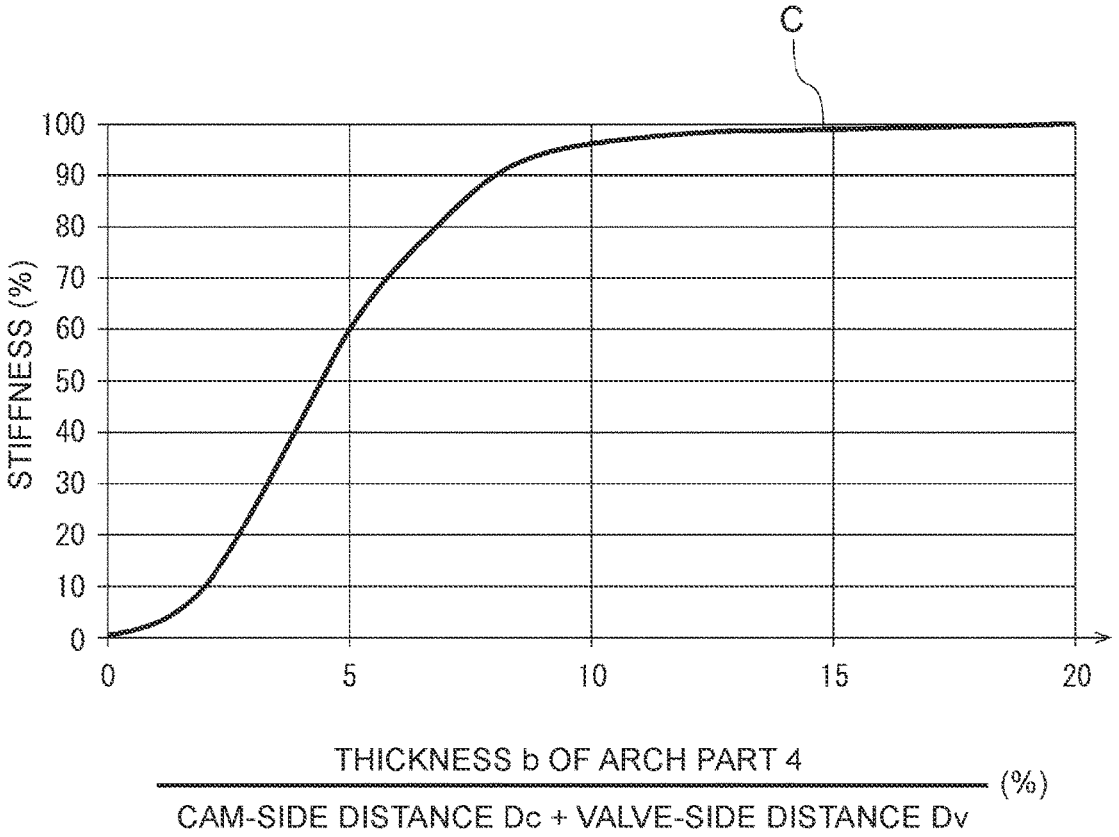
FIG. 8 is a diagram showing a relationship between the stiffness and the thickness of an arch part of a rocker arm according to an embodiment of the present invention.

Next, the rocker arm 2 constituting the valve train 1 shown in FIG. 1 will be described with reference to FIGS. 2 to 8. FIG. 2 is a diagram showing the rocker arm 2 according to an embodiment of the present invention, in which a lightweight part 5 is composed of a plate member 51. FIG. 3A is a cross-sectional view of the rocker arm 2 according to an embodiment of the present invention, corresponding to GG cross-section of FIG. 2. FIG. 3B is a cross-sectional view of the rocker arm 2 according to another embodiment of the present invention, corresponding to GG cross-section of FIG. 2. FIG. 4 is a cross-sectional view of the rocker arm 2 according to an embodiment of the present invention, corresponding to HH cross-section of FIG. 2. FIG. 5 is a diagram showing the rocker arm 2 according to an embodiment of the present invention, in which a lightweight part 5 is composed of a plurality of rod members 53. FIG. 6 is a cross-sectional view of the rocker arm according to an embodiment of the present invention, corresponding to GG cross-section of FIG. 5. FIG. 7 is a cross-sectional view of the rocker arm according to an embodiment of the present invention, corresponding to HH cross-section of FIG. 5. FIG. 8 is a diagram showing a relationship between the stiffness and the thickness of an arch part of the rocker arm 2 according to an embodiment of the present invention.

As shown in FIGS. 2 and 5, the rocker arm 2 is a part of the transmission mechanism 8; the rocker arm 2 is swingably supported by an arm shaft 88 and operates the valve 7 by the rotation of the cam 6. The rocker arm 2 includes an arm body part 3, an arch part 4, and a lightweight part 5.

Each portion of the rocker arm 2 will be described. In the following description, the terms upper and lower (up and down) correspond to upper and lower (up and down) sides in the figures. For instance, the direction of gravity may be lower, and its opposite direction may be upper. In the following description, the thickness direction corresponds to the direction of a normal line on figures, and the thickness is a length in this direction. Further, a point at which a force generated by the rotation of the cam 6 (i.e., a pressing force to press the rocker arm 2 upward) is applied to the rocker arm 2 is referred to as a cam-side load application point Pc, and a point at which a force generated when the rocker arm 2 oscillates in response to the rotation of the cam 6 (i.e., a pressing force to press the valve 7 downward) is applied to the valve 7 is referred to as a valve-side load application point Pv.

The arm body part 3 is a main portion which serves to convert a force generated by the rotation of the cam 6 to a force to press the valve 7 downward in the rocker arm 2. The arm body part 3 includes a bearing portion 31, a cam-side arm portion 32, and a valve-side arm portion 33. The bearing portion 31 of the arm body part 3 is a portion supported by the arm shaft 88. In the embodiments shown in FIGS. 1 to 8, as shown in FIGS. 2 and 5, the bearing portion 31 has a thorough hole penetrating the arm body part 3 in the thickness direction (direction of the normal line on the figures) so as to have a cylindrical shape extending in the thickness direction (see FIGS. 3A to 3B). Additionally, the arm shaft 88 supported by the cylinder head or the like is inserted into the through hole of the bearing portion 31.

That is, the arm body part 3 (rocker arm 2) is supported by the arm shaft 88 at the bearing portion 31 and is rotatable (swingable) around the arm shaft 88 (fulcrum PP). The bearing portion 31 may be fixed to the arm shaft 88 or may be configured to be rotatable with respect to the arm shaft 88. Further, as shown in FIG. 3A, the thickness a of the arm body part 3 at the bearing portion 31 may be equal to the thickness b of the arch part 4 (a=b or a≈b) to reduce the weight of the rocker arm 2. Alternatively, as shown in FIG. 3B, the thickness a of the arm body part 3 at the bearing portion 31 may be more than the thickness b of the arch part 4 (a>b) to improve the strength (durability) of the rocker arm 2.

The cam-side arm portion 32 of the arm body part 3 is a portion which extends from the bearing portion 31 toward a first side of the arm body part 3. On the other hand, the valve-side arm portion 33 of the arm body part 3 is a portion which extends from the bearing portion 31 toward a second side of the arm body part 3. That is, the cam-side arm portion 32 and the valve-side arm portion 33 extend in opposite directions. A distal end (cam-side end 32*e*) of the cam-side arm portion 32 is connected to the cam 6 side. On the other hand, a distal end (valve-side end 33*e*) of the valve-side arm portion 33 is connected to the valve 7 side. Further, as shown in FIGS. 2 and 5, the cam-side load application point Pc is generated on a lower edge of the cam-side end 32*e* connected to the cam 6 side (in FIG. 1, the push rod 82); whereas the valve-side load application point Pv is generated on a lower edge of the valve-side end 33*e* connected to the valve 7 side (in FIG. 1, the bridge 85).

In the embodiments shown in FIGS. 4 and 7, the thickness a of the valve-side arm portion 33 of the arm body part 3 is equal to the thickness b of the arch part 4 (a=b or ab). However, the invention is not limited to these embodiments. For instance, the thickness a of the valve-side arm portion 33 of the arm body part 3 may be more than the thickness b of the arch part 4 (a>b) to further reduce the weight of the arch part 4.

The arch part 4 is a portion which extends over the bearing portion 31 and connects the cam-side arm portion 32 and the valve-side arm portion 33. When the arch part 4 is connected to the arm body part 3 in this way, a pseudo truss structure is formed by the arm body part 3 and the arch part 4, so that the stiffness of the rocker arm 2 is increased. That is, the arch part 4 supports the arm body part 3 so as to suppress (reduce) the deformation amount of the arm body part 3 which undergoes elastic deformation by the action of the force generated by the rotation of the cam 6. Thus, the arch part 4 increases the stiffness of the arm body part 3 (rocker arm 2). In the embodiments shown in FIGS. 1 to 8, the arch part 4 has a cuboidal shape with a rectangular cross-section (FIGS. 3A to 4, 6, and 7). However, the invention is not limited to these embodiments. The cross-section of the arch part 4 may have another shape, such as circular, elliptical, or H-shape. The arch part 4 may have a cylindrical shape with a hollow portion formed along the longitudinal direction.

In the embodiment shown in FIGS. 1 to 8, as shown in FIGS. 2 and 5, the arch part 4 extends over the bearing portion 31 and connects an upper portion of the cam-side end 32*e* of the cam-side arm portion 32 and an upper portion of the valve-side end 33*e* of the valve-side arm portion 33. When the arch part 4 is connected to the upper portion of the cam-side end 32*e* and the upper portion of the valve-side end 33*e*, it is possible to increase the stiffness of the arm body part 3, compared with a case where the arch part 4 is connected to a portion other than the end of at least one of the cam-side arm portion 32 and the valve-side arm portion 33.

More specifically, when the cam 6 rotates, the arm body part 3 is pressed upward at the cam-side end 32*e*. Further, the pressing force generated by the rotation of the cam 6 causes the arm body part 3 to oscillate. With this oscillation, the arm body part 3 presses the bridge 85 downward at the valve-side end 33*e*. At this time, the arm body part 3 receives a reaction force from the bridge 85 and is thereby pressed upward at the valve-side end 33*e*. In this way, since both the cam-side end 32*e* and the valve-side end 33*e* (both distal ends) are pressed upward while the arm body part 3 is held at the bearing portion 31, the arm body part 3 is about to elastically deform so as to curve with the bearing portion 31 at the bottom. However, the arch part 4 supports the both distal ends, to which the upward forces are applied, from above downward. That is, the upward pressing force applied to one of the distal ends becomes an axial force of the arch part 4 and serves as a pressing force to press the other distal end downward, thereby counteracting the upward pressing force applied to the other distal end. Consequently, the arch part 4 serves to suppress elastic deformation of the arm body part 3 and increases the stiffness of the arm body part 3 (rocker arm 2). In particular, when the both ends of the arch part 4 are connected to the both distal ends of the arm body part 3 respectively, it is possible to approximate positions, to which the upward pressing force and the downward pressing force are applied, in the transverse direction (direction perpendicular to the up-down direction in the figures) at the respective distal ends, and thus it is possible to more effectively increase the stiffness of the arm body part 3.

The lightweight part 5 is a portion disposed in a space S defined between the arm body part 3 and the arch part 4. The lightweight part 5 has a reduced weight compared with a case where the space S is filled with the same material at the same thickness as the arch part 4. The lightweight part 5 less contributes to the increase in stiffness of the rocker arm 2 and mainly serves to support the arch part 4. Although the stiffness of the rocker arm 2 can be increased by the arch part 4, the weight of the rocker arm 2 increases by the weight of the arch part 4. To suppress the increase in weight of the entire rocker arm 2 by the weight of the arch part 4, the rocker arm 2 includes the lightweight part 5.

For instance, as described below, the lightweight part 5 may be composed of a plate member 51 (see FIG. 2), or the lightweight part 5 may be composed of a plurality of rod members 53 (see FIG. 5). The lightweight part 5 may be formed by filling the space S with a material (hereinafter, lightweight material), such as metal or resin, having a smaller density (mass per unit volume) than a material of the arch part 4 at the same thickness as the arch part 4. Alternatively, the plate member 51 or the plurality of rod members 53 described below may be made of this lightweight material. In each of these embodiments, since the arch part 4 is supported by the lightweight part 5, it is possible to improve the strength (durability) of the arch part 4. Alternatively, the lightweight part 5 may be the space S as is. In this case, it is possible to maximally suppress the increase in weight of the rocker arm 2 due to the arch part 4.

In the embodiments shown in FIGS. 1 to 8, the arm body part 3 and the arch part 4 are made of the same material. For instance, the rocker arm 2 may be manufactured by integrally molding at least the arm body part 3 and the arch part 4 by casting, or may be manufactured by processing a sheet material. In this case, as shown in FIG. 3B, when taper is formed on the surface of each of the arm body part 3, the arch part 4, and the lightweight part 5, manufacturing can be easily performed.

With the above configuration, it is possible to significantly increase the stiffness of the rocker arm 2 while suppressing the increase in weight of the rocker arm 2. That is, the rocker arm 2, in which the arch part 4 extends over the bearing portion 31 and is connected to the arm body part 3 as well as the lightweight part 5 is disposed between the arch part 4 and the arm body part 3, has a truss structure. In other words, the truss structure allows a bending load which acts on the rocker arm 2 to be supported by an axial load in the arch part 4. Thus, it is possible to improve the stiffness of the rocker arm 2, compared with the rocker arm 2 having a conventional beam structure. Further, it is possible to suppress the increase in weight of the rocker arm 2 by the lightweight part 5, compared with a case where the space S defined between the arm body part 3 and the arch part 4 is filled with the same material at the same thickness as the arch part 4, for instance, like a case where the rocker arm 2 does not include the lightweight part 5, and the arm body part 3 is provided with a rib (a rib composed of a portion corresponding to the arch part and a portion corresponding to the lightweight part). Consequently, it is possible to significantly increase the stiffness of the rocker arm 2 by the arch part 4 while suppressing the increase in weight of the rocker arm 2 by the lightweight part 5.

Furthermore, with the above configuration, since the stiffness is increased while suppressing the increase in weight of the rocker arm 2, it is possible to improve the natural frequency of the valve train 1 including the rocker arm 2, and it is possible to suppress the occurrence of jumping of the valve train 1. Further, since the occurrence of jumping of the valve train 1 is suppressed, it is possible to increase the open and closing height of the valve 7 such as an intake valve and an exhaust valve. This reduces pressure loss (pumping loss) at intake and exhaust, thus improving the efficiency of the engine. Further, since the seating speed of the valve 7 or the like can be decreased, it is possible to elongate the lifetime of the parts, and it is possible to prevent troubles associated with breakage of the parts. It is possible to decrease a reduction in lift amount caused when, for instance, an early closing of the intake valve is performed for improving the efficiency of the engine. In the embodiments shown in FIGS. 1 to 8, it was observed that pumping loss is reduced by 40% approximately.

Next, embodiments of the lightweight part 5 will be described.

In some embodiments, as shown in FIGS. 2 to 4, the lightweight part 5 is composed of a plate member 51 disposed so as to fill the space S and having a smaller thickness than the arch part 4. In the embodiments shown in FIGS. 2 to 4, as shown in FIGS. 3A to 4, the thickness e of the plate member 51 is smaller than the thickness b of the arch part 4 (thickness e<thickness b). Thus, not only when the plate member 51 is made of the lightweight material, but also when the plate member 51 is made of the same material as the arch part 4, the weight of the rocker arm 2 is reduced compared with a case where the thickness e of the plate member 51 is equal to the thickness b of the arch part 4. Further, since the plate member 51 is disposed between the arm body part 3 and the arch part 4, the arch part 4 can be supported by the plate member 51, and the arch part 4 is prevented from deforming.

With the above configuration, since the arch part 4 is supported by the lightweight part 5 composed of the plate member 51, the arch part 4 can be reinforced. Thus, it is possible to improve the strength (durability) of the arch part 4. Further, the lightweight part 5 can be easily produced by forming the lightweight part 5 in a plate shape.

In some embodiments, as shown in FIGS. 5 to 7, the lightweight part 5 is composed of a plurality of rod members 53 arranged at an interval in the space S and connecting the arm body part 3 and the arch part 4. In the embodiments shown in FIGS. 5 to 7, as illustrated, the plurality of rod members 53 are composed of four rod-shaped members. Further, each of the rod members 53 extends radially from an upper portion of the bearing portion 31 to the arch part 4 and thereby connects the arm body part 3 and the arch part 4. That is, the rod members 53 connect the arm body part 3 and the arch part 4 so that the direction of a component force directed to the space S in the arch part 4 coincides with the direction of a force in the axial directions of the rod member 53. Thereby, the strength (durability) of the arch part 4 is improved.

In the embodiments shown in FIGS. 5 to 7, a cross-section of each of the rod members 53 has a rectangular shape, and the thickness e thereof is smaller than the thickness b of the arch part 4 (e<b). However, the invention is not limited to these embodiments. For instance, in some other embodiments, the thickness e of each of the rod members 53 may be equal to the thickness b of the arch part 4 (e=b), or the thickness e of each of the rod members 53 may be equal to or less than the thickness b of the arch part 4 (e≤b). The cross-sectional shape of each of the rod members 53 may be another shape, such as circular, elliptical, H-shape, or annular shape.

In the embodiments shown in FIGS. 5 to 7, as illustrated, the sizes (thicknesses) of the cross-sections of the rod members 53 are not uniform, and the cross-sections have different sizes. This variation is to cover a force which is increased on the valve-side end 33*e* side of an apex 4*p* (described later) and applied to the arch part 4. To this end, the rod member 53 positioned where a larger force is applied has a larger thickness. Thereby, the strength (durability) of each of the rod members 53 is adjusted in accordance with the magnitude of the applied force, which makes it possible to suppress the increase in weight while appropriately setting the strength (durability). Further, when a cross-section of a connection portion between the rod member 53 and the arch part 4 or the arm body part 3 is increased in accordance with the magnitude of the applied force, the force locally applied to the connection portion can be distributed over the entire cross-section. Thereby, it is possible to prevent the arch part 4 and the arm body part 3 from breaking due to the force from the rod member 53 at the connection portion.

However, the present invention is not limited to these embodiments. For instance, in some other embodiments, the number of the rod members 53 may be adjusted instead of adjusting the thicknesses of the rod members 53 as described above. That is, the number of the rod members 53 positioned where a larger force is applied may be increased so that the same effect is achieved as the case where the thicknesses of the rod members 53 are adjusted. In some other embodiments, the thicknesses of all the rod members 53 may be the same. The plurality of rod members 53 represent two or more rod members 53. In some other embodiments, for instance, at least one rod member 53 of the plurality of rod members 53 connects the arm body part 3 and the arch part 4, and the other rod members 53 may be variously positioned within the range of the above effect, such as a rod member 53 connected to the at least one rod member 53 and a rod member 53 vertically extending from an upper surface of the cam-side arm portion 32 or the valve-side arm portion 33.

With the above configuration, since the arch part 4 is supported by the plurality of rod members 53 which are, for instance, arranged spokewise to form the lightweight part 5, the arch part 4 can be reinforced. Thus, it is possible to improve the strength (durability) of the arch part 4. Further, since the lightweight part 5 is formed by the plurality of rod members 53, it is possible to further reduce the weight of the rocker arm 2.

In some embodiments, as shown in FIGS. 2 and 5, the arch part 4 has an apex 4*p* at which a separation distance Is from a reference line Lb connecting the cam-side load application point Pc and the valve-side load application point Pv is maximized. The arch part 4 is formed so that the separation distance Is increases from the valve-side arm portion 33 toward the apex 4*p* and the separation distance Is decreases from the apex 4*p* toward the cam-side arm portion 32. In the embodiments shown in FIGS. 1 to 8, the separation distance Is continuously increases from an end of the arch part 4 adjacent to the valve-side arm portion 33 toward the apex 4*p*. In other words, the separation distance Is continuously decreases from the apex 4*p* toward the end of the arch part 4 adjacent to the valve-side arm portion 33. Meanwhile, the separation distance Is continuously increases from an end of the arch part 4 adjacent to the cam-side arm portion 32 toward the apex 4*p*. In other words, the separation distance Is continuously decreases from the apex 4*p* toward the end of the arch part 4 adjacent to the cam-side arm portion 32. That is, the arch part 4 has an arched shape with an arc-shape line connecting the cam-side end 32*e* (e.g., the cam-side load application point Pc), the apex 4*p*, and the valve-side end 33*e* (e.g., the valve-side load application point Pv).

However, the shape of the arch part 4 is not limited to the shape in the embodiments shown in FIGS. 1 to 8. The separation distance Is may not continuously change as shown in FIGS. 2 and 5. For instance, the arch part 4 may be shaped so that a line connecting the cam-side end 32*e* (e.g., the cam-side load application point Pc), the apex 4*p*, and the valve-side end 33*e* (e.g., the valve-side load application point Pv) is triangular or polygonal.

With the above configuration, the arch part 4 has the apex 4*p* at which the distance from the reference line Lb, which is a straight line connecting the cam-side load application point Pc and the valve-side load application point Pv, is maximized, and the distance from the reference line Lb increases from each load application point toward the apex 4*p*. Thereby, it is possible to more efficiently increase the stiffness of the rocker arm by the arch part 4.

In some embodiments, as shown in FIGS. 1 to 5, a valve-side distance Dv between the oscillation center (fulcrum PP serving as the central axis of the arm shaft 88) of the rocker arm 2 and the valve-side load application point Pv is larger than a cam-side distance Dc between the oscillation center and the cam-side load application point Pc, and the apex 4*p* is positioned on the valve-side load application point Pv side with respect to the oscillation center.

With the above configuration, since the valve-side distance Dv is longer than the cam-side distance Dc, it is possible to increase the open and closing height of the valve 7 in accordance with the cam lift amount. Further, since the apex 4*p* of the arch part 4 is positioned on the valve-side load application point Pv side with respect to the oscillation center (fulcrum PP) of the rocker arm 2, it is possible to more efficiently increase the stiffness of the rocker arm 2 by the arch part 4.

In some embodiments, the thickness b of the arch part 4 (see FIGS. 3A to 4, 6, 7) is 5% or more and 15% or less of a length obtained by adding the valve-side distance Dv to the cam-side distance Dc. More specifically, the present inventors have intensively studied and found that, although the stiffness of the rocker arm 2 increases as the thickness b of the arch part 4 increases, the stiffness becomes saturated and no longer increases when a ratio of the thickness of the arch part 4 to the sum (Dv+Dc) of the valve-side distance Dv and the cam-side distance Dc reaches a predetermined value. This will be described using FIG. 8. FIG. 8 shows a stiffness characteristic C which indicates a relationship between the stiffness of the rocker arm 2 and a ratio (b/(Dv+Dc)) of the thickness b of the arch part 4 to the sum of the valve-side distance Dv and the cam-side distance Dc. As described later, since the stiffness characteristic C related to the thickness b of the arch part 4 (hereinafter, simply referred to as stiffness characteristic C) shows saturated stiffness as a value on the horizontal axis increases, a value of the saturated stiffness is represented as 100% on the vertical axis.

As illustrated in FIG. 8, in the stiffness characteristic C, a value of the stiffness represented on the vertical axis does not monotonously increase with an increase in value on the horizontal axis; instead, the value of the stiffness gradually becomes saturated while its increasing rate gradually decreases with an inflexion point. More specifically, the value of the stiffness represented on the vertical axis increases at a maximum rate (change rate) as the value (percentage) on the horizontal axis increases from 0% to about 5% (first inflexion point Ca), and the value of the stiffness increases to about 60% when the value on the horizontal axis is about 5%. Further, in a region where the value on the horizontal axis is between 5% and 8% approximately (second inflexion point Cb), the value of the stiffness increases at a smaller change rate than the change rate before the first inflexion point Ca and increases to about 90% when the value on the horizontal axis is about 8%. On the other hand, the value of the stiffness is saturated (100%) when the value on the horizontal axis is about 20%. After the second inflexion point Cb, the value of the stiffness gently increases to the saturated value at a minimum change rate as the thickness of the arch part 4 increases.

As described above, the stiffness of the rocker arm 2 can be increased to a saturated value as the thickness b of the arch part 4 increases. However, on the other hand, since the weight of the arch part 4 (rocker arm 2) monotonously increases as the thickness b of the arch part 4 increases, the inertia increases with the increase in weight. That is, the stiffness of the rocker arm 2 increased by the arch part 4 is decreased by the inertia. Thus, when the thickness b of the arch part 4 is determined so that the value on the horizontal axis is 5% or more, it is possible to achieve the maximum effect of increasing the stiffness of the rocker arm 2 while suppressing the increase in weight of the rocker arm 2. On the other hand, it is unnecessary to determine the thickness b of the arch part 4 so that the value on the horizontal axis is more than 20% which no longer provides the effect of increasing the stiffness of the rocker arm 2. That is, when the thickness b of the arch part 4 is determined so that the value on the horizontal axis is 5% or more and 20% or less, it is possible to increase the stiffness of the rocker arm 2. In a range where the value on the horizontal axis is more than 15%, although the stiffness increases, the increase in stiffness is insignificant, compared with the increase in weight. Thus, even when the value on the horizontal value is 5% or more and 15% or less, the stiffness of the rocker arm 2 can be increased as much as when the value on the horizontal axis is 20%. Furthermore, when the thickness b of the arch part 4 is determined so that the value on the horizontal axis is 5% or more and 8% or less, it is possible to achieve about 90% of stiffness obtainable by the increase in thickness b of the arch part 4 while suppressing the increase in weight of the rocker arm 2.

With the above configuration, since the thickness b of the arch part 4 is determined based on the above-described novel finding, it is possible to more efficiently increase the stiffness while suppressing the increase in weight of the rocker arm 2.

In some embodiments, the width d of the arch part 4 (see FIGS. 2 and 5) is 3% or more of the length obtained by adding the valve-side distance Dv to the cam-side distance Dc. The arch part 4 is a portion receiving the stress, and the width d of the arch part 4 is desirably large to increase the stiffness of the rocker arm 2. However, the weight of the arch part 4 (rocker arm 2) increases as the width d of the arch part 4 increases. Thus, it is desirable to determine the width d of the arch part 4 so that a ratio (d/(Dv+Dc)) of the width d of the arch part 4 to the sum of the valve-side distance Dv and the cam-side distance Dc is 3% or more. In the embodiments shown in FIGS. 1 to 8, for instance, the width d of the arch part 4 is determined so that the ratio (d/(Dv+Dc)) is 3% or more and 4% or less, e.g., 3.7%. Thereby, it is possible to ensure the strength (durability) of the arch part 4 to increase the stiffness of the rocker arm 2.

In some embodiments, the separation distance Is of the apex 4*p* from the reference line Lb is equal to or less than the valve-side distance Dv. The stiffness of the rocker arm 2 is increased by the arch part 4 as the separation distance Is of the apex 4*p* from the reference line Lb increases; however, when the separation distance Is exceeds a certain value, the stiffness no longer increases and becomes saturated. On the other hand, as the separation distance Is increases, the entire length of the arch part 4 increases, and thus the weight of the rocker arm 2 increases. With the above configuration, since the separation distance Is of the apex 4*p* from the reference line Lb is equal to or less than the valve-side distance Dv, it is possible to more efficiently increase the stiffness while suppressing the increase in weight of the rocker arm 2.

In some embodiments, a ratio (q/p) of a distance q between the cam-side load application point Pc and an intersection Lo between the reference line Lb and a perpendicular line Lh passing through the apex 4*p* and perpendicular to the reference line Lb to a distance p between the valve-side load application point Pv and the intersection Lo ranges from 0.8 to 1.2. As shown in FIGS. 2 and 5, the oscillation center (fulcrum PP serving as the central axis of the arm shaft 88) of the rocker arm 2 is positioned on the cam-side end 32*e* side from the longitudinal center of the arm body part 3. When $0.8 \leq q/p \leq 1.2$, the apex 4*p* can be positioned on the valve-side end 33*e* side with respect to the oscillation center of the rocker arm 2. In the embodiment shown in FIGS. 1 to 8, q/p is 1.1. In some other embodiments, q/p is 1.0. Thereby, it is possible to more efficiently increase the stiffness by the arch part while suppressing the increase in weight of the rocker arm.

Embodiments of the present invention were described in detail above, but the present invention is not limited thereto, and various amendments and modifications may be implemented.

REFERENCE SIGNS LIST

1 Valve train
2 Rocker arm
3 Arm body part
31 Bearing portion
32 Cam-side arm portion
32*e* Cam-side end
33 Valve-side arm portion
33*e* Valve-side end
4 Arch part
4*p* Apex
5 Lightweight part
51 Plate member
53 Rod member
6 Cam
62 Protrusion
63 Top
66 Cam shaft
7 Valve
71 Shaft portion
71*f* Front end
71*r* Back end
72 Head portion
74 Valve seat
8 Transmission mechanism
81 Cam follower
82 Push rod
84 Spring
85 Bridge
86 Acting plate
87 Guide portion
88 Arm shaft
S Space (Space defined between arm body part and arch part)
Lb Reference line
Lh Perpendicular line
Lo Intersection
Is Separation distance
PP Fulcrum of lever (Central axis of arm shaft)
Pc Cam-side load application point
Pv Valve-side load application point
a Thickness of arm body part
b Thickness of arch part
e Thickness of plate member (lightweight part)
d Width of arch part
Dc Cam-side distance
Dv Valve-side distance
C Stiffness characteristic related to thickness of arch part
Ca First inflexion point
Cb Second inflexion point
O Rotational center of cam
q Distance (Distance between Lo and Pc)
p Distance (Distance between Lo and Pv)

The invention claimed is:

1. A rocker arm swingably supported by an arm shaft and operating a valve by rotation of a cam, the rocker arm comprising:

an arm body part including a bearing portion supported by the arm shaft, a cam-side arm portion extending from the bearing portion toward a first side, and a valve-side arm portion extending from the bearing portion toward a second side;

an arch part extending over the bearing portion and connecting the cam-side arm portion and the valve-side arm portion; and a lightweight part disposed in a space defined between the arm body part and the arch part, the lightweight part having a reduced weight compared with a case where the space is filled with the same material at the same thickness as the arch part, wherein, when a straight line passing through a fulcrum of the rocker arm and being orthogonal to a first reference line is defined as a second reference line, the first reference line connecting a cam-side load application point and a valve-side load application point, wherein the lightweight part includes a cam-side lightweight part located on the cam-side load application point side with respect to the second reference line and a valve-side lightweight part located on the valve-side load application point side with respect to the second reference line, the valve-side lightweight part having a larger volume than the cam-side lightweight part, wherein the lightweight part comprises a plurality of rod members and at least one space part formed between adjacent rod members, the plurality of rod members being arranged at an interval in the space and connecting the arm body part and the arch part, wherein the plurality of rod members include at least one cam-side rod member located on the cam-side load application point side with respect to the second reference line and at least one valve-side rod member located on the valve-side load application point side with respect to the second reference line, the at least one valve-side rod member having a lager cross-section than the at least one cam-side rod member.

2. The rocker arm according to claim 1, wherein the arch part has an apex at which a separation distance from the first reference line is maximized, and the arch part is shaped so that the separation distance increases from the valve-side arm portion toward the apex and the separation distance decreases from the apex toward the cam-side arm portion.

3. The rocker arm according to claim 2, wherein a valve-side distance between an oscillation center of the rocker arm and the valve-side load application point is larger than a cam-side distance between the oscillation center and the cam-side load application point, and wherein the apex is positioned on a valve-side load application point side with respect to the oscillation center.

4. The rocker arm according to claim 3, wherein a thickness of the arch part is 5% or more and 15% or less of a length obtained by adding the valve-side distance to the cam-side distance.

5. The rocker arm according to claim 3, wherein the separation distance of the apex from the first reference line is equal to or less than the valve-side distance.

6. The rocker arm according to claim 3, wherein a ratio (q/p) of a distance q between the cam-side load application point and an intersection between the first reference line and a perpendicular line passing through the apex and perpendicular to the first reference line to a distance p between the valve-side load application point and the intersection ranges from 0.8 to 1.2.

7. The rocker arm according to claim 1, wherein the lightweight part exists at least in a region of the space in which the second reference line extends.

8. The rocker arm according to claim 1, wherein each of the plurality of rod members extends radially from an upper portion of the bearing portion to the arch part.

* * * * *